US009249647B2

(12) United States Patent
Kobe et al.

(10) Patent No.: US 9,249,647 B2
(45) Date of Patent: Feb. 2, 2016

(54) TUBING HANGER WITH ROTARY DISC VALVE

(71) Applicant: OneSubsea IP UK Limited, London (GB)

(72) Inventors: Benjamin Kobe, Houston, TX (US); Dean Porter, Houston, TX (US)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/465,606

(22) Filed: Aug. 21, 2014

(65) Prior Publication Data

US 2015/0191994 A1 Jul. 9, 2015

Related U.S. Application Data

(60) Provisional application No. 61/925,115, filed on Jan. 8, 2014.

(51) Int. Cl.
*E21B 34/04* (2006.01)
*E21B 33/04* (2006.01)

(52) U.S. Cl.
CPC ..... *E21B 34/04* (2013.01); *E21B 33/04* (2013.01)

(58) Field of Classification Search
CPC ..... E21B 33/043; E21B 34/04
USPC ..... 166/344, 348, 350, 368, 86.1, 88.4, 166/85.1, 87.1, 89.1, 208, 382, 25.14
See application file for complete search history.

(56) References Cited

U.S. PATENT DOCUMENTS

| | | | | |
|---|---|---|---|---|
| 4,703,807 | A * | 11/1987 | Weston | 166/373 |
| 5,706,893 | A * | 1/1998 | Morgan | 166/86.1 |
| 6,729,392 | B2 * | 5/2004 | DeBerry et al. | 166/75.14 |
| 7,195,225 | B1 * | 3/2007 | Holliday | 251/63.5 |
| 2001/0042619 | A1 * | 11/2001 | Gatherar et al. | 166/86.3 |

FOREIGN PATENT DOCUMENTS

| | | | |
|---|---|---|---|
| EP | 1707737 | A1 | 10/2006 |
| WO | 0173256 | A1 | 10/2001 |

* cited by examiner

*Primary Examiner* — James G Sayre
(74) *Attorney, Agent, or Firm* — Chamberlain Hrdlicka

(57) ABSTRACT

A production assembly for a subsea well, the assembly comprising a tubing hanger landed in the production assembly, the tubing hanger suspending production tubing from the production assembly, an annulus surrounding the production tubing, and an actuatable rotary disc valve comprising a disc and two seats, wherein the disc is rotatable between two seats to an open position in which one or more apertures in the rotary disc valve are aligned with one or more apertures in the seats, and a closed position in which the one or more apertures in the rotary disc valve are offset from the one or more apertures in the seats, wherein, the annulus is not capable of fluid communication through the tubing hanger when the actuatable rotary disc valve is in the closed position.

26 Claims, 17 Drawing Sheets

TUBING HANGER WITH ROTARY DISC VALVE

CROSS REFERENCE TO RELATED APPLICATIONS

This application claims the benefit of U.S. Provisional Application 61/925,115, filed Jan. 8, 2014.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Tubing hangers are used in completion of oil and gas wells. A typical completion system comprises a wellhead housing which is installed at the upper end of a well bore, optionally a tubing spool connected to the top of the wellhead housing including a central bore and a tubing hanger which is landed in the central bore. The process of installing a tubing hanger into a flow completion system involves positioning the tubing hanger into the tubing spool/wellhead using a tubing hanger running tool or similar device. In subsea applications, the tubing hanger is generally run through a marine riser and blowout preventer stack before landing in the tubing spool/wellhead.

The tubing hanger supports production tubing or tubing string for producing fluids from the well. The tubing string extends down into the production zone of the well and includes a production bore and defines an annulus bore surrounding the tubing string. Often, the tubing hanger provides porting to allow communication of hydraulic, electric and other downhole functions, as well as chemical injection. The tubing hanger can also serve to seal-in annulus and production areas.

For a tubing hanger installed inside a wellhead, the annulus bore which flows through the tubing hanger can be used for monitoring pressure or communicating fluid to and from the annulus below the tubing hanger. After well completion, a Christmas tree can be installed above the wellhead assembly to control production from the well. Before the Christmas tree is installed, all flow passages including the annulus bore must be sealed off to provide a temporary fluid barrier so that the blowout preventer, connected to the wellhead during completion, can be removed.

Typically, annulus isolation valves are installed inside of the tubing hanger to provide a barrier preventing annulus bore fluid communication through the tubing hanger. Traditional tubing hanger annulus isolation valves present a number of problems, including: space limitation, reliability, durability, restricted flow area, added cost and inconvenience of employing wireline tools to open and/or close the valves, and potential flow erosion of sealing surfaces. The present invention solves and/or mitigates one or more of the issues set forth above by providing a rotary disc valve capable of isolating annulus fluid communication through the tubing hanger.

BRIEF SUMMARY

The present invention relates to a tubing hanger with a rotary disc valve for use in a subsea system used to produce oil or gas from a subsea well. In particular, the invention relates to a tubing hanger comprising an annulus bore located outside of a tubing string and a rotary disc valve for controlling fluid flow through the annulus bore. The claimed rotary disc valve can be actuated/rotated by a variety of methods, detailed below.

Some tree system designs require the annulus bore to flow through the tubing hanger assembly. Due to space limitations, it is very difficult to design an annulus bore valve which provides adequate flow area for the annulus and also allows room in the tubing hanger assembly for other features such as hydraulic and electrical feedthroughs. Various designs are possible but have serious reliability problems due to sealing technology. One example of the present invention includes an annulus bore valve that uniquely implements traditional gate valve sealing technology and can therefore be made very robust. Since the annulus is often exposed to gas, there is a major concern for using elastomeric seals due to their susceptibility to explosive decompression and aging. One example of the present invention can have metal to metal sealing technology and, therefore, will not have explosive decompression or elastomer aging concerns. Further, unlike the present invention, several prior art designs require seals to move out of the sealing bore while under pressure, exposing them to a risk of blowout or damage.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Moreover, the use of "top," "bottom," "above," "below," and variations of these terms is made for convenience, but does not require any particular orientation of the components.

The present invention is an actuatable rotary disc valve used for isolating fluid flow within a tubing hanger located in a subsea completion system for a subsea well. The rotary disc valve can be used for isolating fluid flow through an annulus bore in a tubing hanger. Those of ordinary skill in the art will understand that the rotary disc valve could be used for fluid isolation in wellhead equipment other than a tubing hanger.

Figure 1:
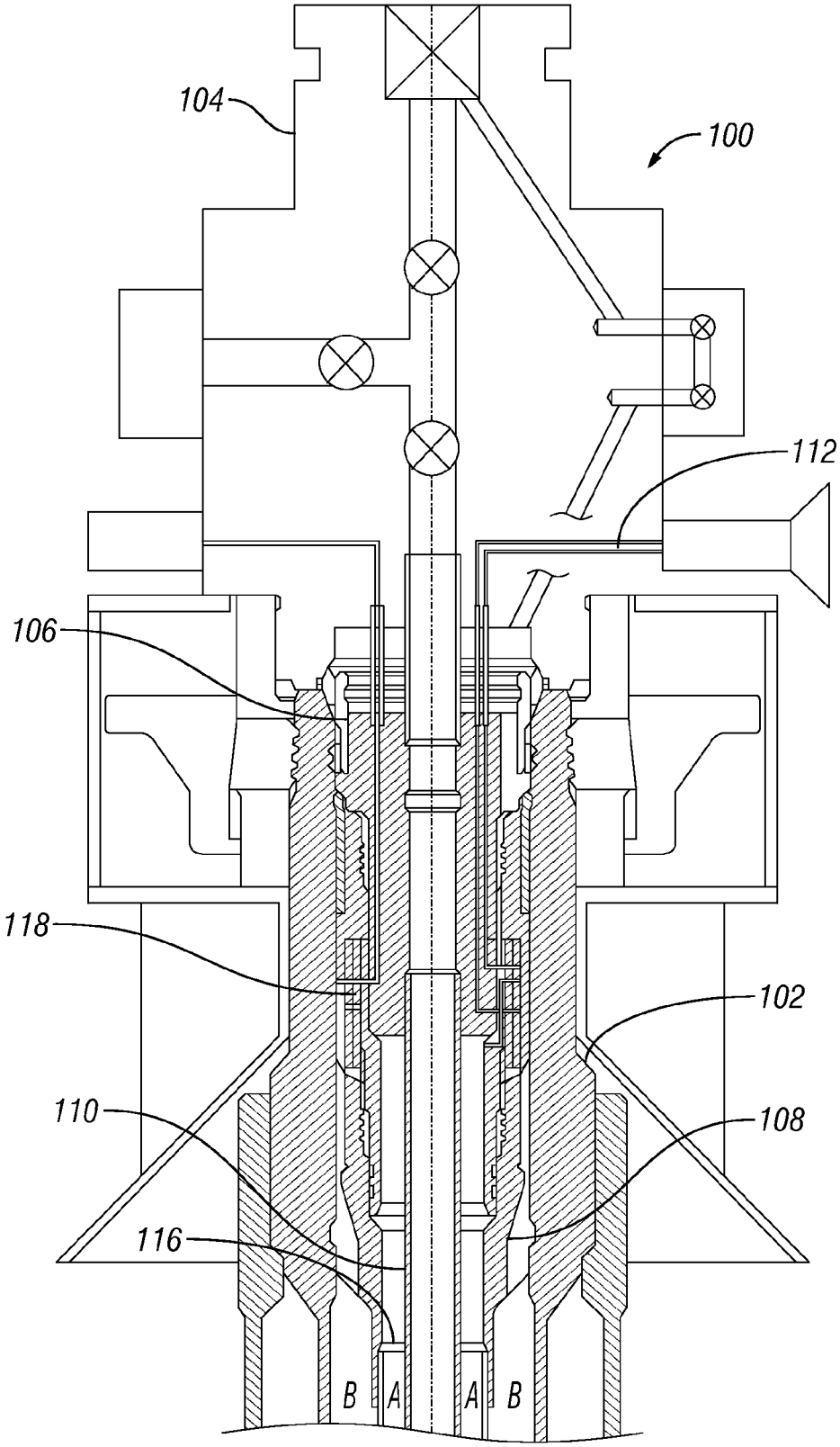
FIG. 1 is a schematic representation of a subsea completion including a wellhead and also including a production tree installed on the wellhead with a tubing hanger installed in the annulus access adapter and configured as a monobore completion.

FIG. 1 shows a schematic representation of an embodiment of a subsea completion system and assembly 100 in accordance with one or more embodiments of the present disclosure is shown. As shown, the subsea completion assembly 100 includes a wellhead housing 102 installed inside a wellbore. The subsea completion assembly 100 includes a production tree 104 above the wellhead housing 102 and a tubing hanger 106 landed in the wellhead housing 102.

Another hanger 108, in this case the production casing hanger, is landed in the wellhead housing 102 and supports a casing string extending into the wellbore inside the high pressure housing casing. The subsea completion assembly 100 also includes the tubing hanger 106 supporting a production tubing 110 extending into the borehole inside the production casing to define an annulus. Another annulus may then be defined as the annulus around the outside of the casing string.

A tubing hanger in accordance with the present disclosure may include a bore, such as a production bore 116, formed therethrough. The tubing hanger may also include a passage, such as an annulus bore 118 passage, also formed therethrough. The production bore 116 of the tubing hanger may be in fluid communication with the internal bore of the production tubing 110, in which the auxiliary passage may be in fluid communication with either annulus.

As such, a valve in accordance with the present disclosure may be used to control fluid flow through the annulus bore 118. In another embodiment, the bore of the hanger may be in fluid communication with either annulus. Accordingly, a tubing hanger in accordance with the present disclosure may be used as a production tubing hanger, a casing tubing hanger, and/or any other type of hanger to support one or more tubular members therefrom without departing from the scope of the present disclosure.

The tubing hanger 106 may also comprise a number of service and/or control conduits 112. In the embodiment of the invention shown in FIG. 1, these conduits 112 are located circumferentially about the tubing hanger 106 and extend into or completely through the tubing hanger 106. The conduits 112 are configured to communicate signals, including control and/or hydraulic signals, across the tubing hanger 106 (i.e., between devices located above and below the tubing hanger) and even within the tubing hanger 106.

Figure 2A:
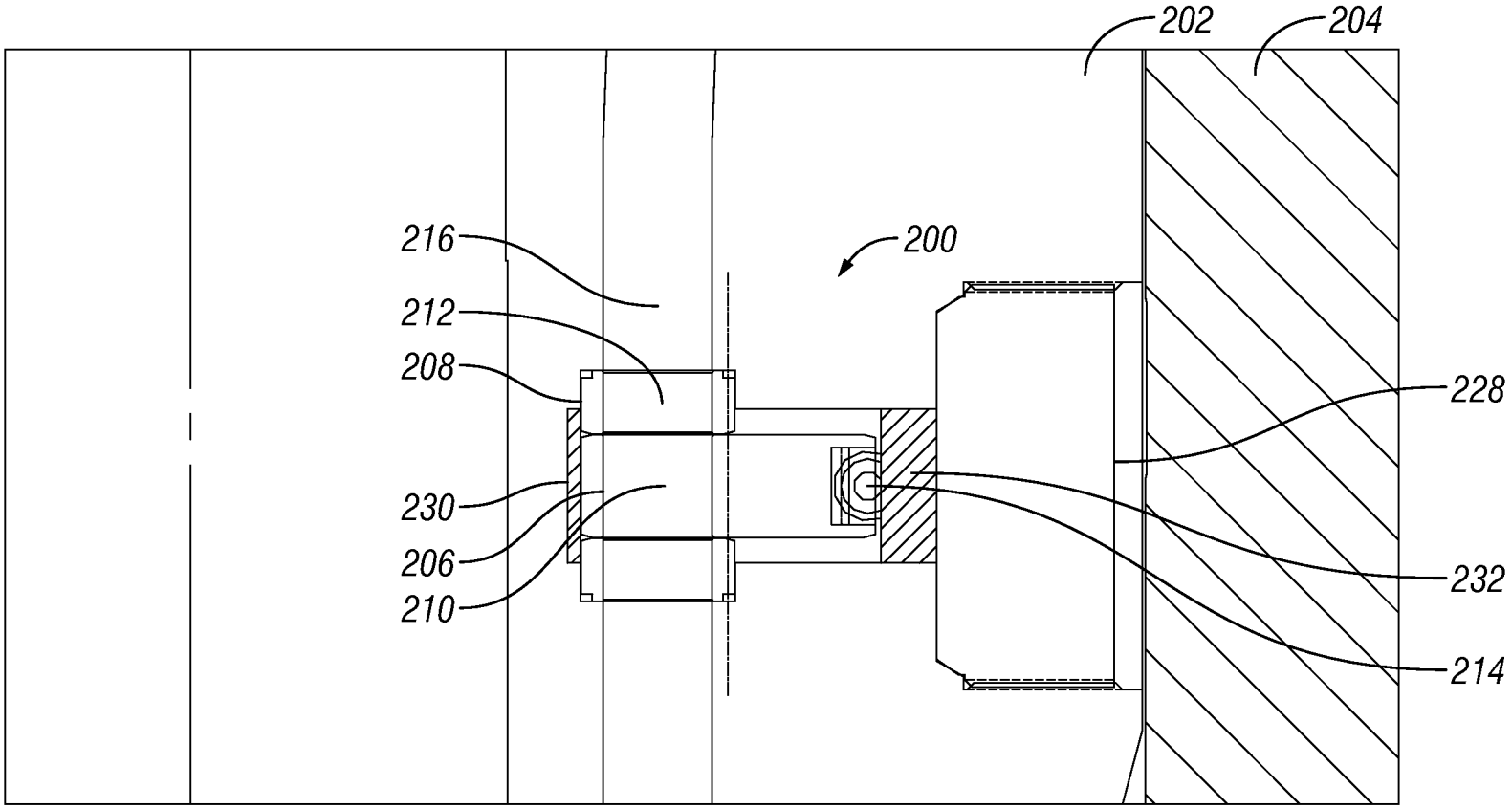
FIG. 2A is a sectional side view of an embodiment of a rotary disc valve and actuation device.
Figure 2B:
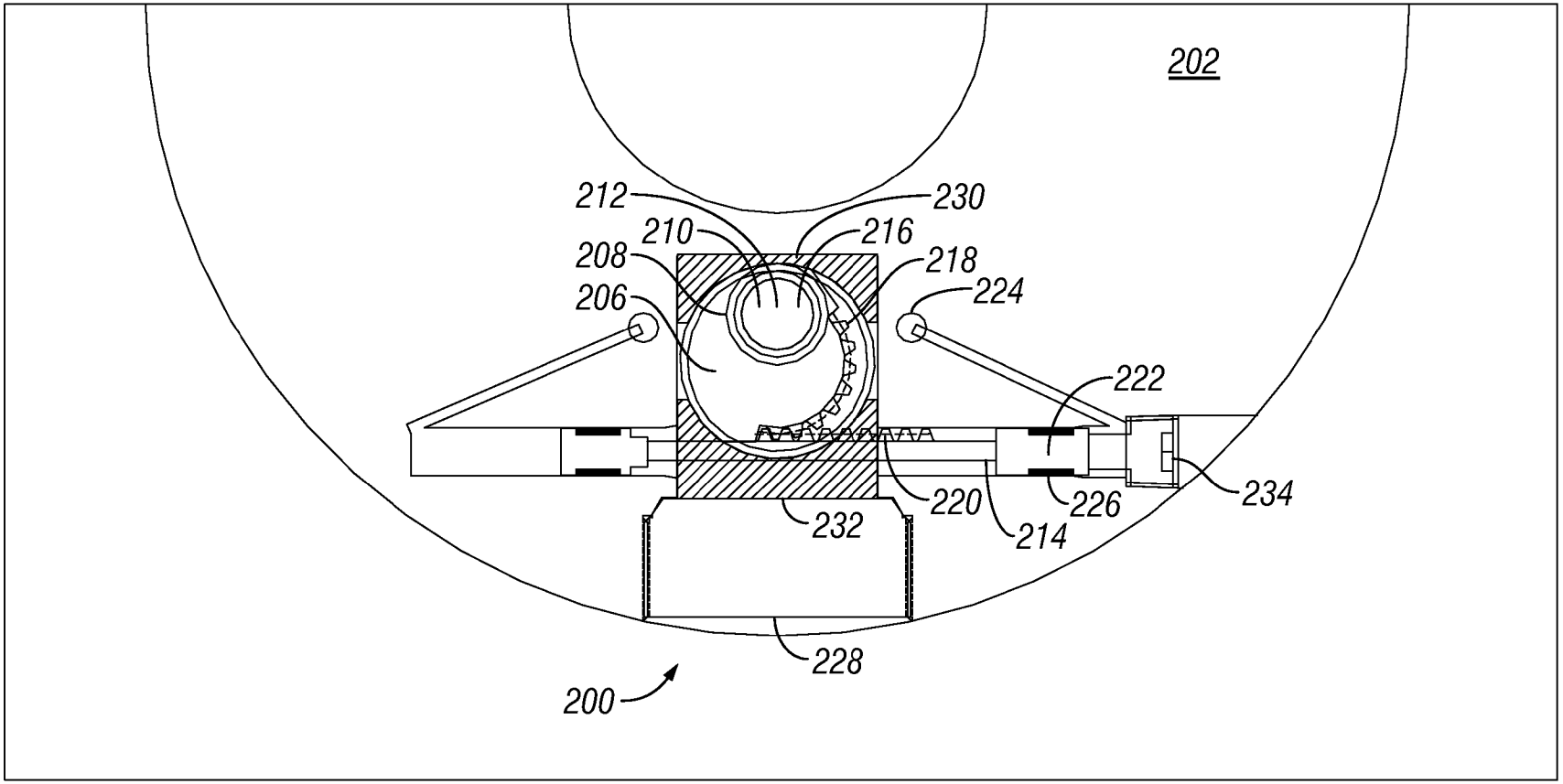
FIG. 2B is a sectional top view of the embodiment of the rotary disc valve and actuation device illustrated in FIG. 2A, wherein the rotary disc valve is in an open position.
Figure 2C:
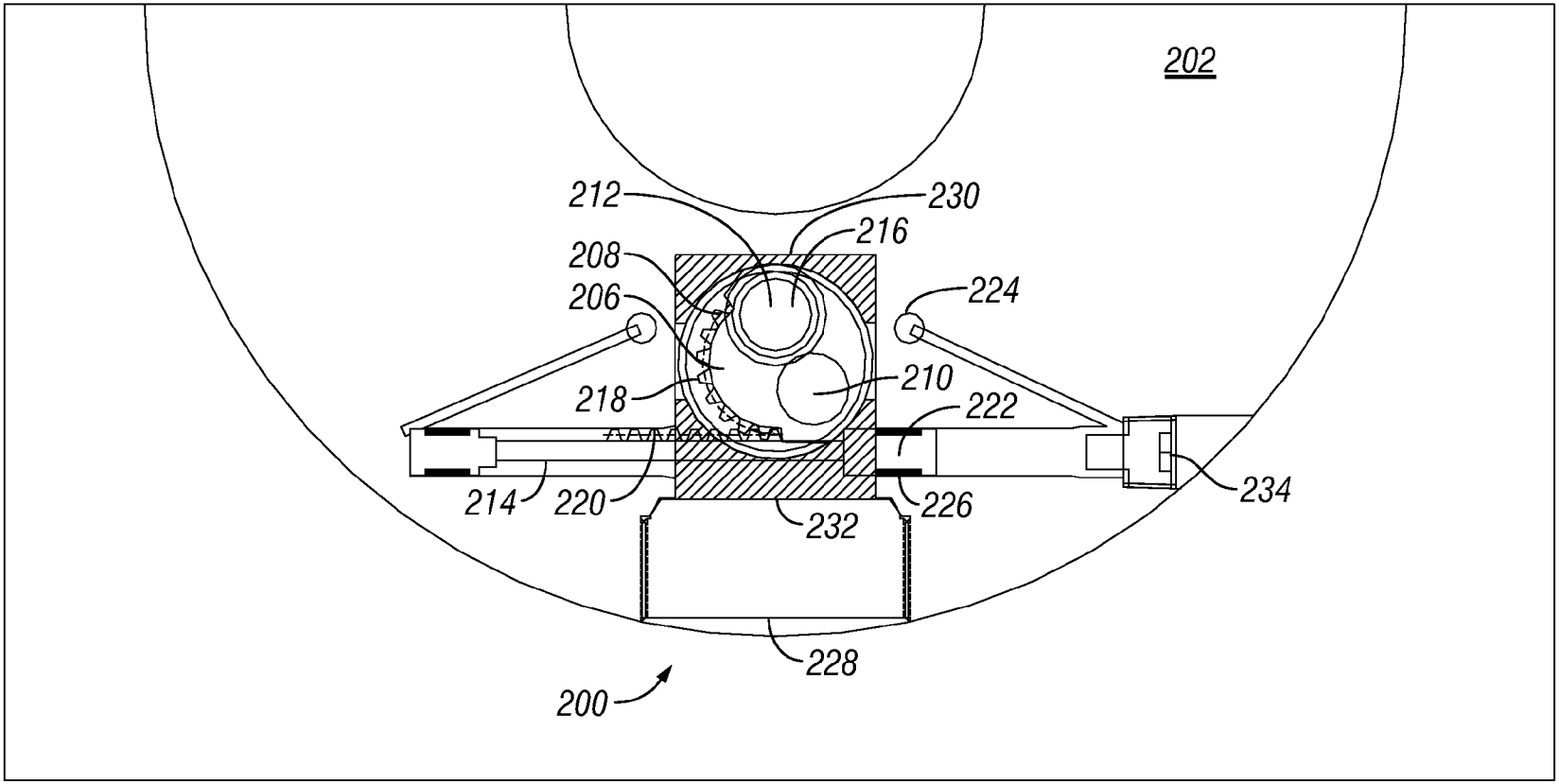
FIG. 2C is a sectional top view of the embodiment of the rotary disc valve and actuation device illustrated in FIG. 2A, wherein the rotary disc valve is in a closed position.

Referring to FIGS. 2A-C, a rotary valve assembly 200 capable of controlling fluid flow through a passage in a tubing hanger 202 is shown. The tubing hanger 202 is shown landed in a wellhead 204 of a subsea installation. In alternative embodiments, the tubing hanger can be landed in a tubing spool, tubing head or any other subsea equipment known to those of ordinary skill in the art in which a tubing hanger can be located.

The rotary valve assembly 200 includes a valve disc 206 which fits between two valve seats 208. In the illustrated embodiment, the valve disc 206 is a circular in shape. In alternative embodiments, the valve disc 206 can be any other shape suitable for sealing.

The valve disc 206 includes an aperture 210 through the disc. The valve seats 208 also include apertures 212 through the valve seats. The valve disc 206 is capable of rotation between an open position as illustrated in FIG. 2B and a closed position as illustrated in FIG. 2C. In the open position, the valve disc aperture 210 is aligned with the valve seat apertures 212, thereby allowing fluid to flow through the disc aperture 210 and the valve apertures 212, thereby enabling fluid communication through the annulus bore 216 across the valve. In the closed position, the valve disc aperture 210 is offset from the valve seat apertures 212, thereby restricting fluid communication across the valve. The valve disc 206 can further include gear teeth 218. In FIG. 2B, the gear teeth 218 are shown cut directly into the valve disc 206. In other embodiments, the gear teeth 218 can be coupled to the valve disc 206 by other means commonly known by those of ordinary skill in the art, such as by adhesive, bolt, screw or other fastener.

In the embodiment illustrated in FIGS. 2A-C, the rotary valve assembly 200 further includes an actuation rack 214. The actuation rack 214 includes gear teeth 220. In FIG. 2B, the gear teeth 220 are shown cut directly into the actuation rack 214. In other embodiments, the gear teeth 218 can be coupled to the actuation rack 214 by other means commonly known by those of ordinary skill in the art, such as by adhesive, welding, bolt, screw or other fastener.

Together, the valve disc 206 and actuation rack 214 comprise a rack and pinion assembly, in which the teeth of the actuation rack 214 engage the teeth of the valve disc 206, causing the valve disc 206 to rotate between the open and closed positions. In the embodiment illustrated in FIGS. 2B-2C, the actuation rack includes a piston 222 which moves jointly with the actuation rack 214. The piston 222 is hydraulically actuated by way of hydraulic fluid supplied from hydraulic ports 224. In the illustrated embodiments, the piston 222 includes seals 226 which prevent hydraulic fluid from entering the inside of the valve cavity.

In FIG. 2B, the piston 222 is biased to the right side of the actuation rack 214, maintain the rotary valve assembly 200 in the open position, i.e., allowing fluid to flow through the valve seat apertures 212 and valve disc aperture 210, thereby providing for fluid communication through the annulus bore 216 across the rotary valve assembly 200. In FIG. 2C, the piston 222 has been actuated, moving it to the left. In this position, the valve disc 206 has rotated to the closed position, wherein the valve disc aperture 210 is offset from the valve seat apertures 212, thereby restricting flow across the valve.

Figure 3A:
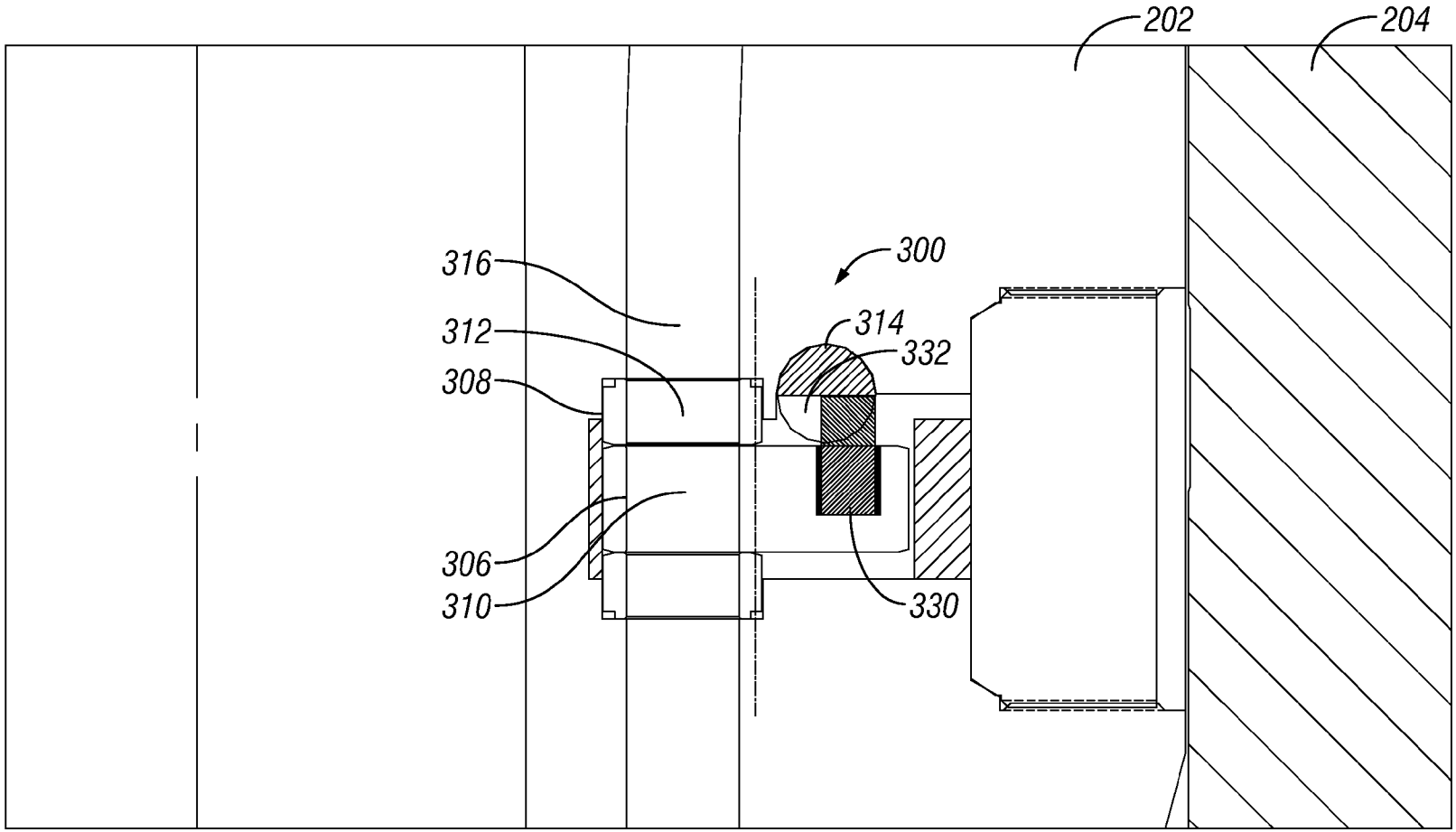
FIG. 3A is a sectional side view of an embodiment of a rotary disc valve and actuation device.
Figure 3B:
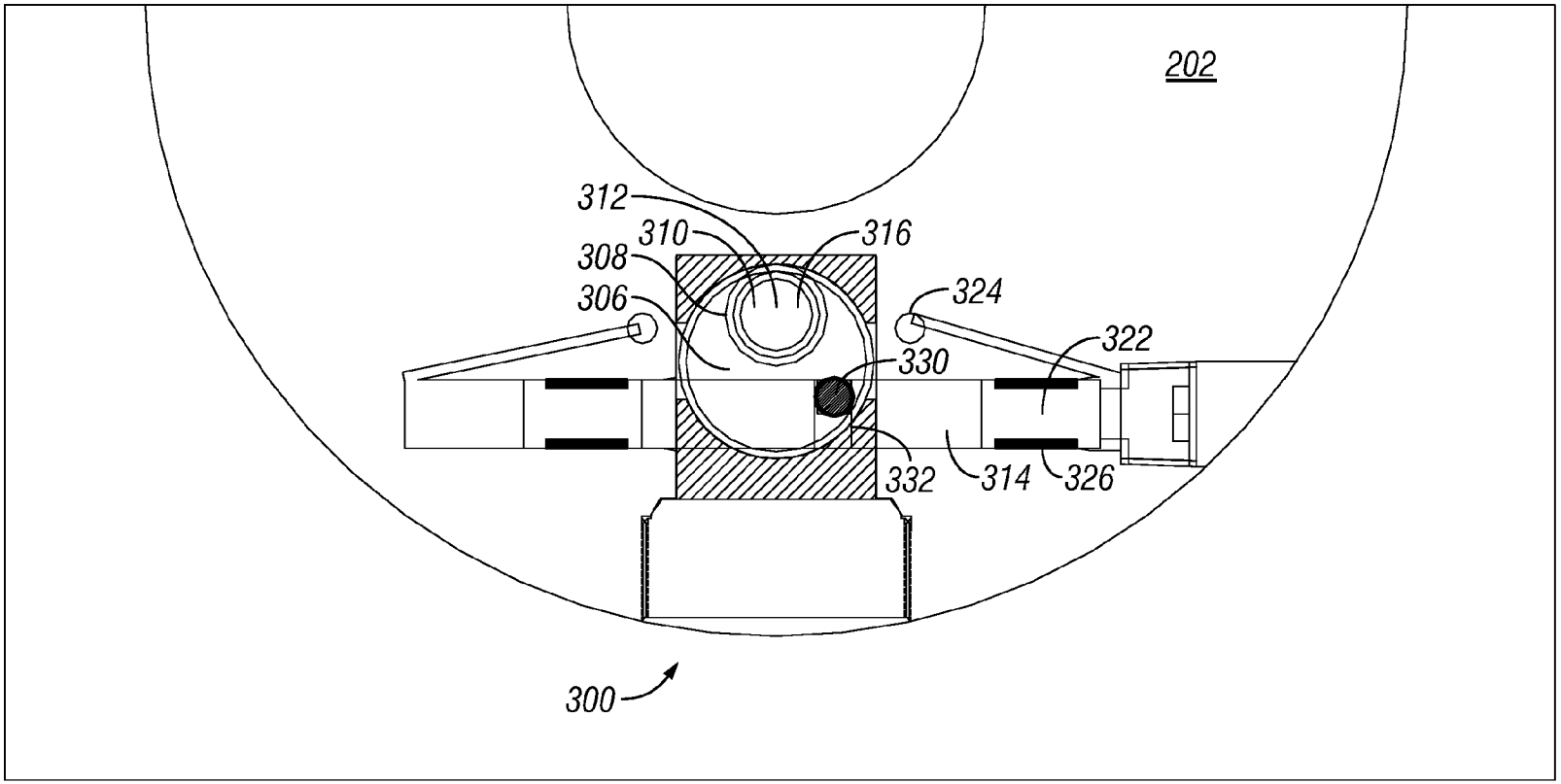
FIG. 3B is a sectional top view of the embodiment of the rotary disc valve and actuation device illustrated in FIG. 3A, wherein the rotary disc valve is in an open position.
Figure 3C:
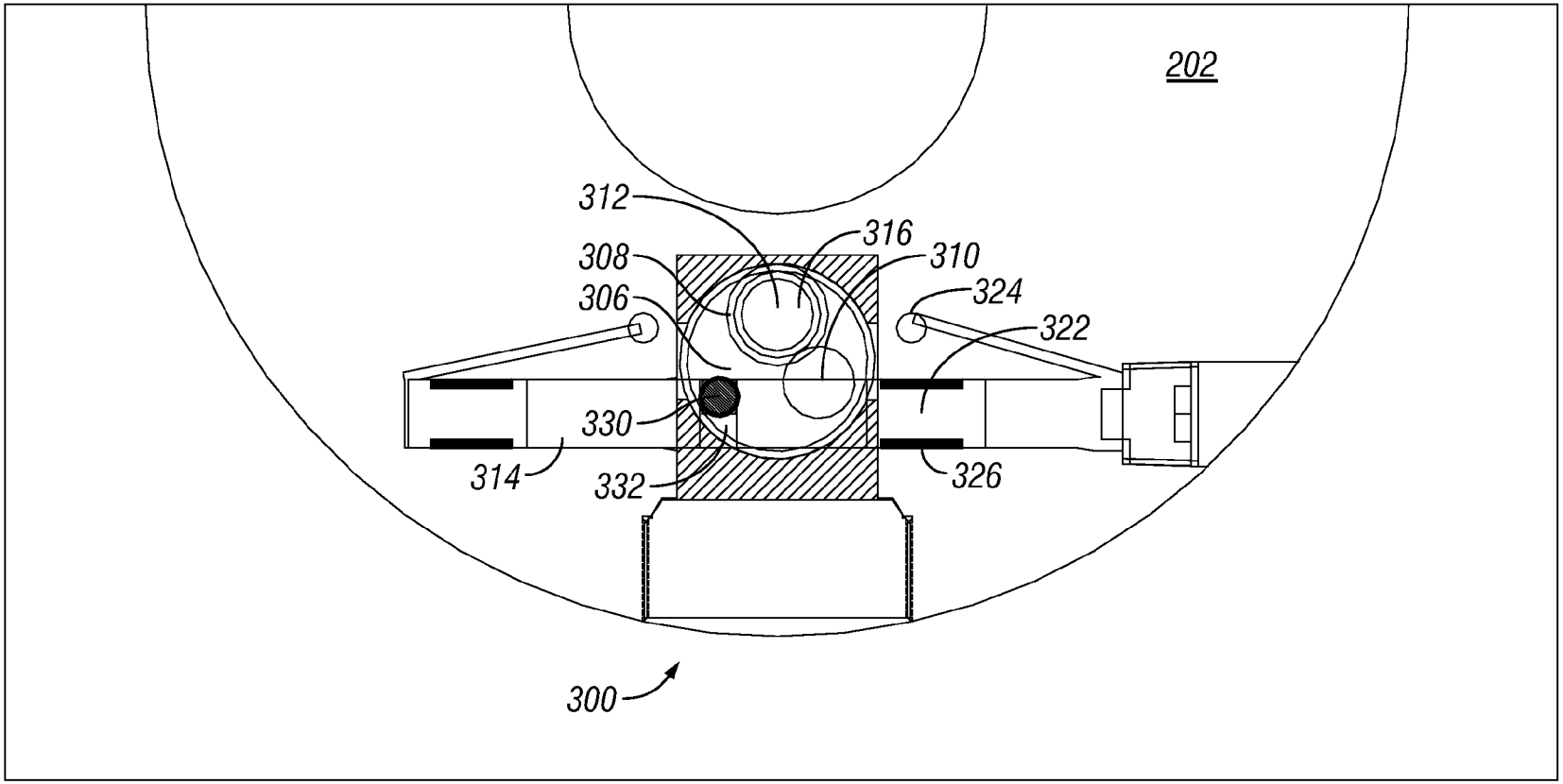
FIG. 3C is a sectional top view of the embodiment of the rotary disc valve and actuation device illustrated in FIG. 3A, wherein the rotary disc valve is in a closed position.

FIGS. 3A-C illustrate another embodiment of a rotary valve assembly 300 capable of controlling fluid flow through a passage in a tubing hanger 202 is shown. Again, the tubing hanger 202 is shown landed in a wellhead 204 of a subsea installation. In alternative embodiments, the tubing hanger can be landed in a tubing spool, tubing head or any other subsea equipment known to those of ordinary skill in the art in which a tubing hanger can be located.

The rotary valve assembly 300 includes a valve disc 306 which fits between two valve seats 308. In the illustrated embodiment, the valve disc 306 is a circular in shape. In alternative embodiments, the valve disc 306 can be any other shape suitable for sealing.

The valve disc 306 includes an aperture 310 through the disc. The valve seats 308 also include apertures 312 through the valve seats. The valve disc 306 is capable of rotation between an open position as illustrated in FIG. 3B and a closed position as illustrated in FIG. 3C. In the open position, the valve disc aperture 310 is aligned with the valve seat apertures 312, thereby allowing fluid to flow through the disc aperture 310 and the valve apertures 312, thereby enabling fluid communication through the annulus bore 316 across the valve. In the closed position, the valve disc aperture 310 is offset from the valve seat apertures 312, thereby restricting fluid communication across the valve. The valve disc 306 can further include a pin 330. In FIG. 3B, the pin 330 is shown integral to the valve disc 306. In other embodiments, the pin 330 can be coupled to the valve disc 306 by other means commonly known by those of ordinary skill in the art, such as by adhesive, welding, bolt, screw or other fastener. In the embodiment illustrated in FIGS. 3A-C, the rotary valve assembly 300 further includes an actuation rack 314. The actuation rack 314 includes a piston 322 which moves jointly with the actuation rack 314. The actuation rack 314 includes a slot 332 through the actuation rack 314.

The slot 332 on the piston 322 allows for the actuation rack 314 to interface with the pin 330 located on the valve disc 306, causing the valve disc 306 to rotate between the open and closed positions. As the valve disc 306 rotates, the pin 330 is free to move within slot 332. The piston 322 is hydraulically actuated by way of hydraulic fluid supplied from hydraulic ports 324. In the illustrated embodiments, the piston 322 includes seals 326 which prevent hydraulic fluid from entering the inside of the valve cavity.

In FIG. 3B, the piston 322 is biased to the right side of the actuation rack 314, maintaining the rotary valve assembly 300 in the open position, i.e., allowing fluid to flow through the valve seat apertures 312 and valve disc aperture 310, thereby providing for fluid communication through the annulus bore 316 across the rotary valve assembly 300. In FIG. 3C, the piston 322 has been actuated, moving it to the left. In this position, the valve disc 306 has rotated to the closed position, wherein the valve disc aperture 310 is offset from the valve seat apertures 312, thereby restricting flow across the valve.

Figure 4A:
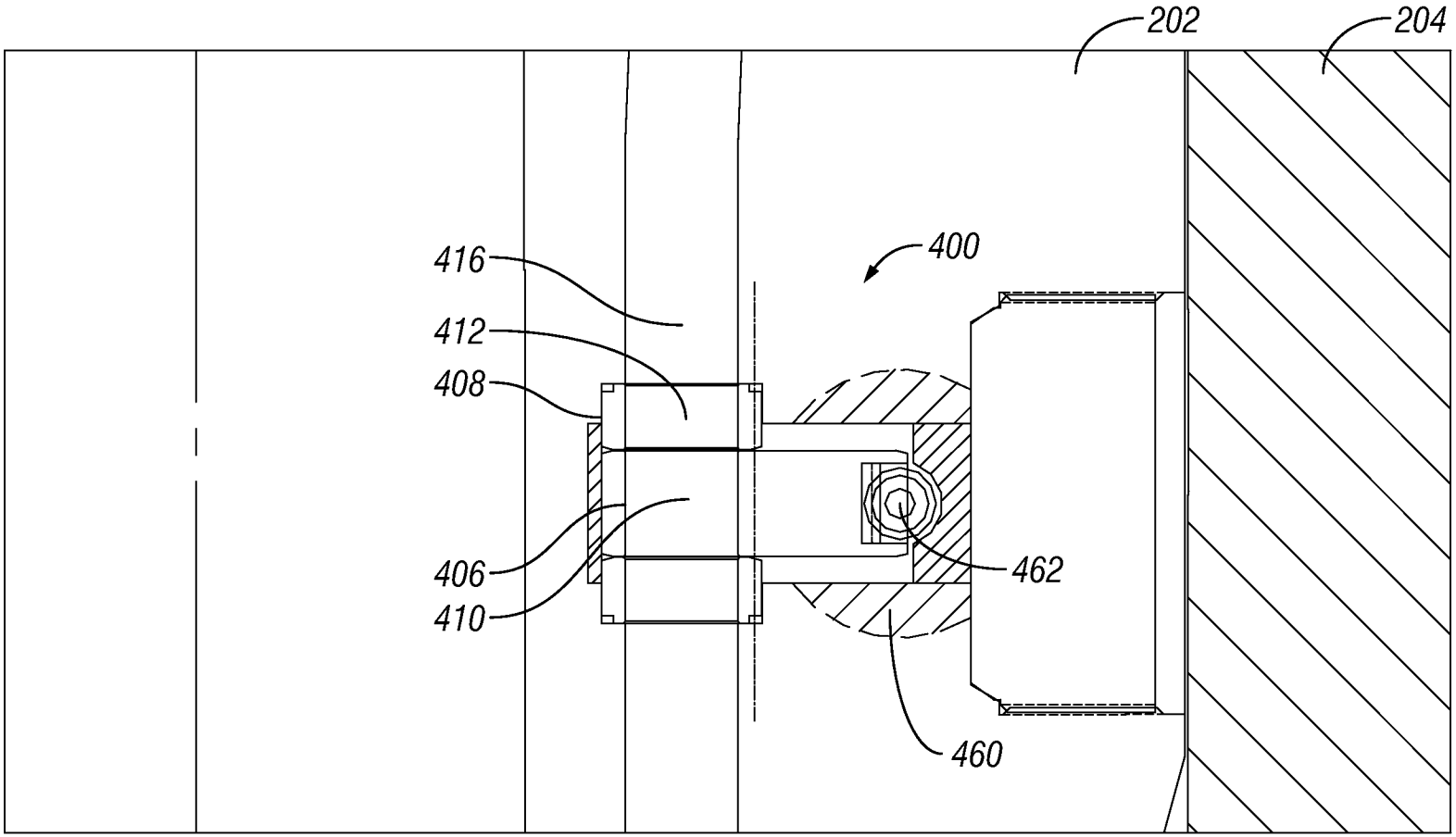
FIG. 4A is a sectional side view of an embodiment of a rotary disc valve and actuation device.
Figure 4B:
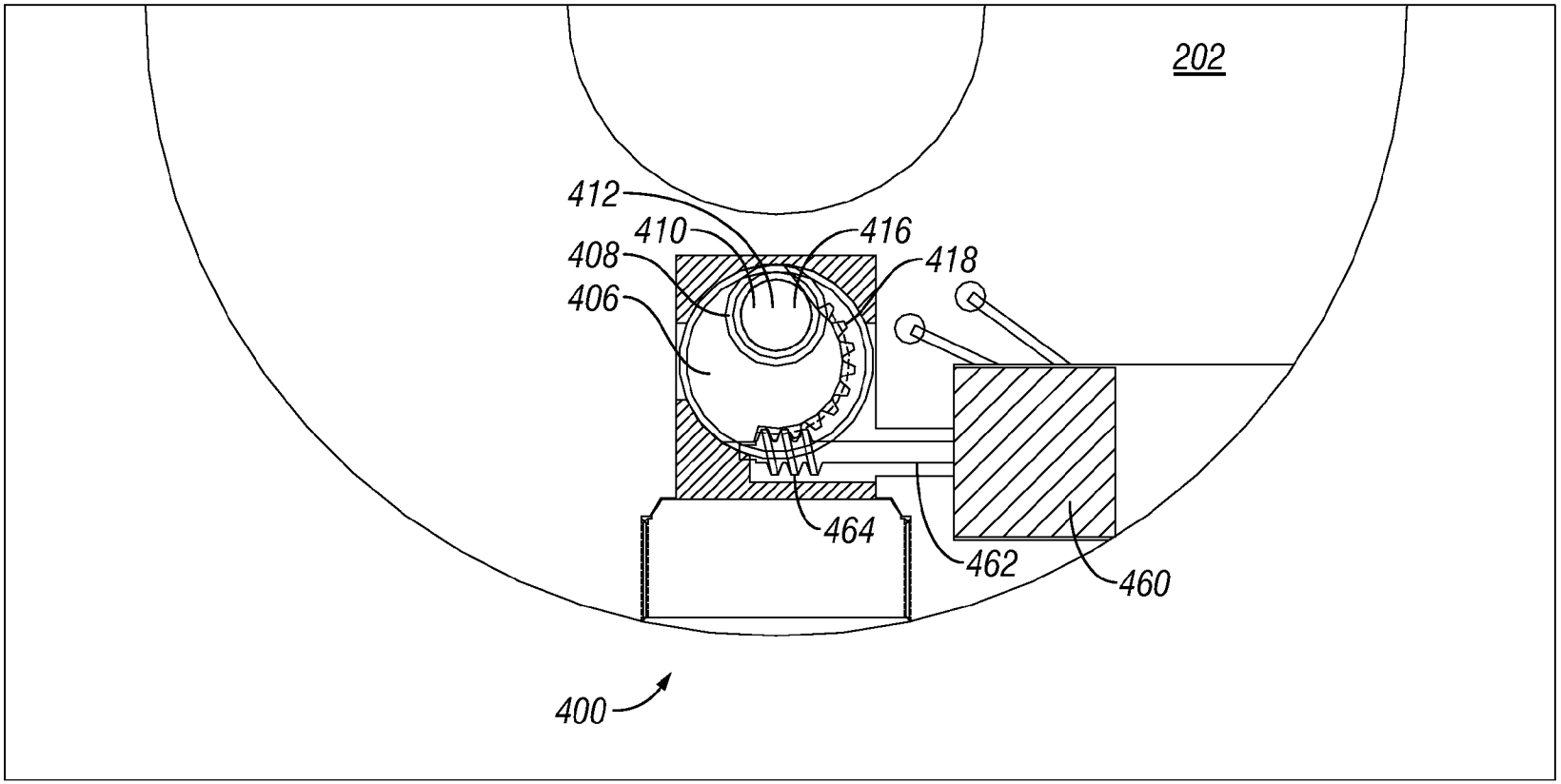
FIG. 4B is a sectional top view of the embodiment of the rotary disc valve and actuation device illustrated in FIG. 4A, wherein the rotary disc valve is in an open position.
Figure 4C:
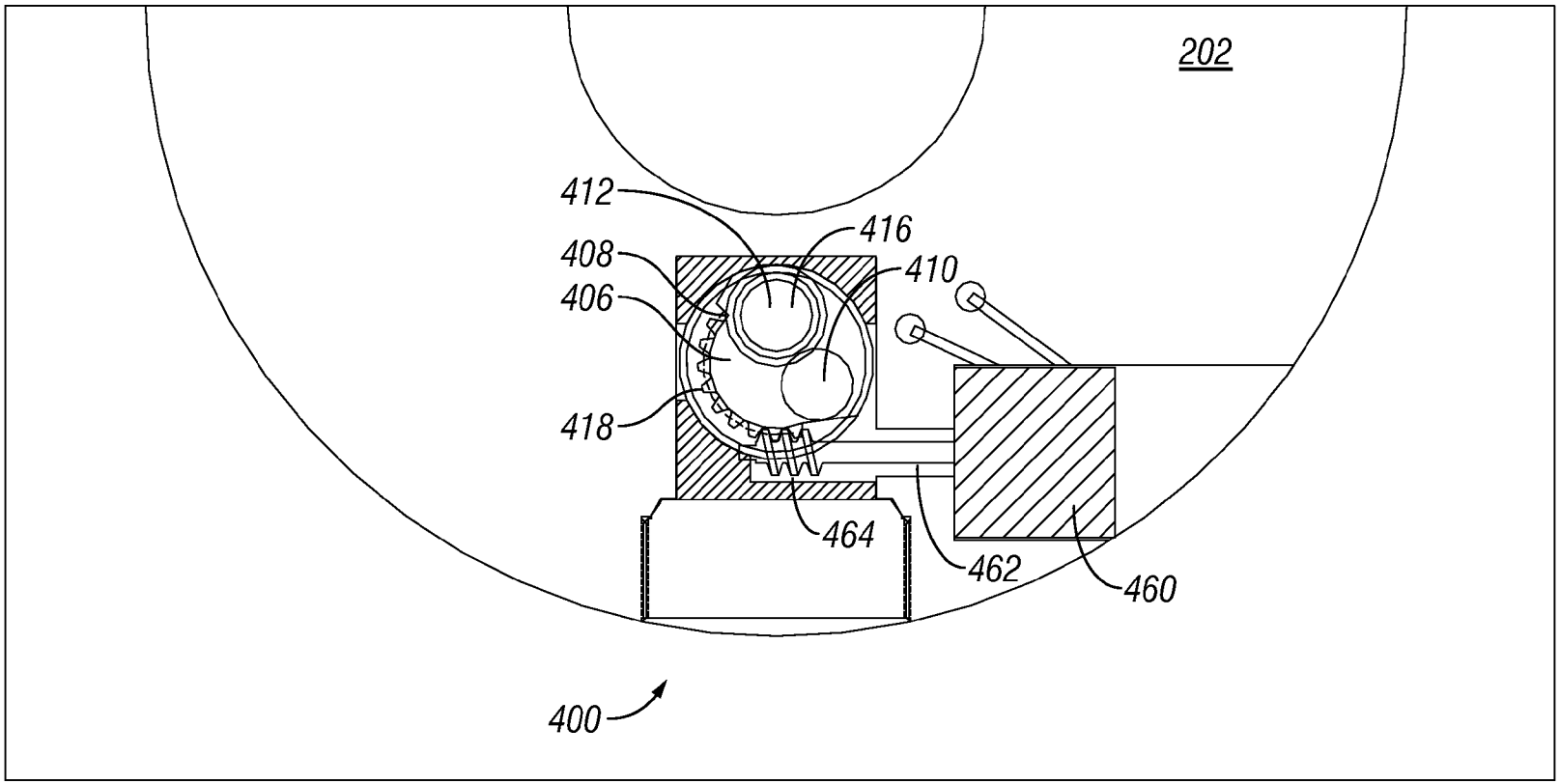
FIG. 4C is a sectional top view of the embodiment of the rotary disc valve and actuation device illustrated in FIG. 4A, wherein the rotary disc valve is in a closed position.

FIGS. 4A-C illustrate another embodiment of a rotary valve assembly 400. The rotary valve assembly 400 includes a valve disc 406 which fits between two valve seats 408. The valve disc 406 includes an aperture 410 through the disc. The valve seats 408 also include apertures 412 through the valve seats. The valve disc 406 is capable of rotation between an open position as illustrated in FIG. 4B and a closed position as illustrated in FIG. 4C. In the open position, the valve disc aperture 410 is aligned with the valve seat apertures 412, thereby allowing fluid to flow through the disc aperture 410 and the valve apertures 412, thereby enabling fluid communication through the annulus bore 416 across the valve. In the closed position, the valve disc aperture 410 is offset from the valve seat apertures 412, thereby restricting fluid communication across the valve. The valve disc 406 can further include gear teeth 418.

In the embodiment illustrated in FIGS. 4A-C, the rotary valve assembly 400 further includes a rotating member 460 disposed within the tubing hanger. The rotating member 460 includes a gear 462 at its terminal end. In FIG. 4B, gear teeth 464 are shown cut directly into the rotating member 460. In other embodiments, the gear teeth 464 can be coupled to the rotating member 460 by other means commonly known by those of ordinary skill in the art, such as by adhesive, welding, bolt, screw or other fastener.

The gear teeth 464 of the gear 462 engage with the gear teeth 418 of the valve disc 406, causing the valve disc 406 to rotate between the open and closed positions. In the embodiment illustrated in FIGS. 4A-4C, the rotating member 460 can be rotated by any rotating means commonly known to those of ordinary skill in the art, including a hydraulic motor in a tubing hanger, production tree or tubing hanger running tool, an electric motor in a tubing hanger, tree or tubing hanger running tool or a remotely operated vehicle tool on a production tree.

Figure 5A:
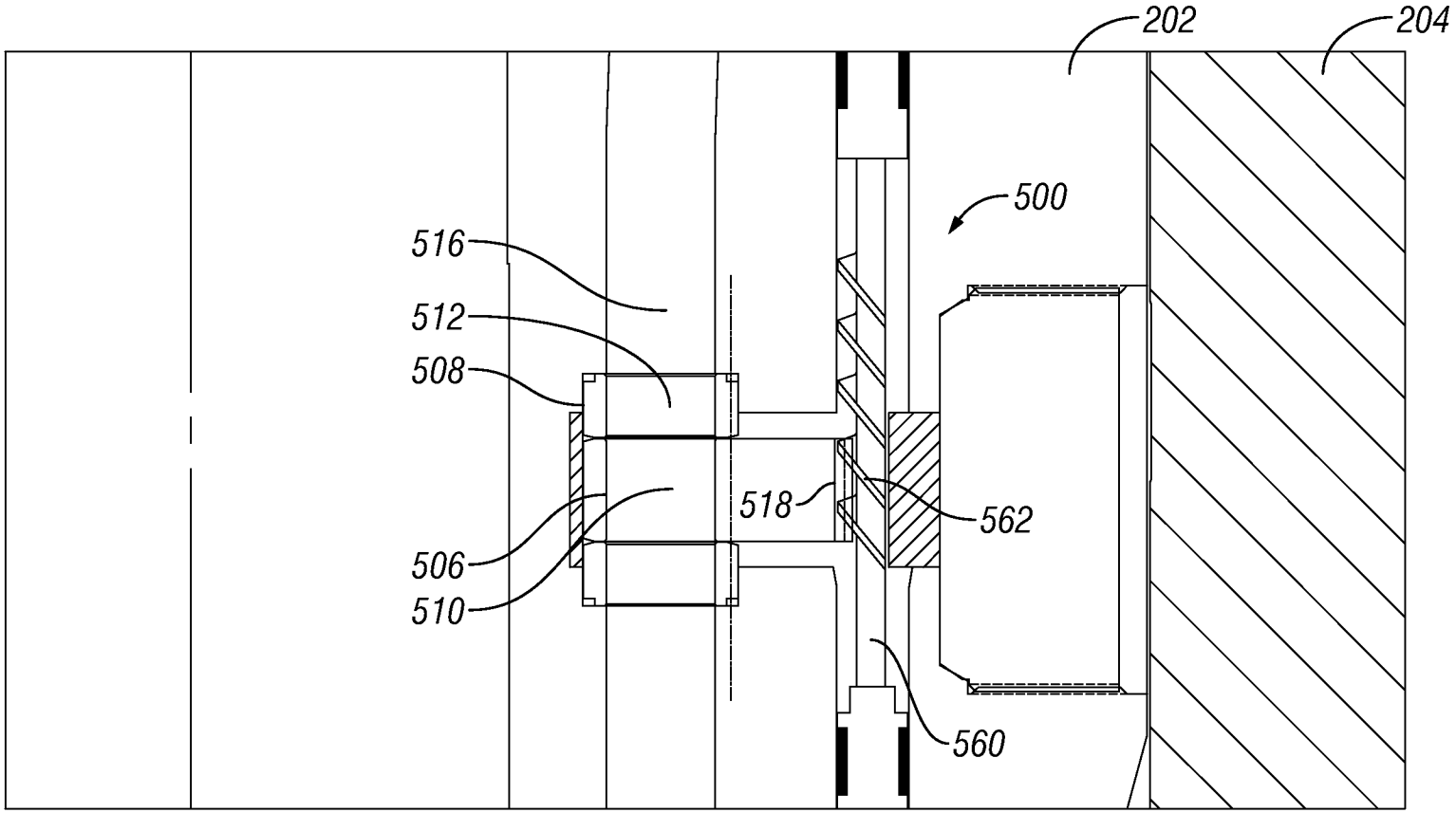
FIG. 5A is a sectional side view of an embodiment of a rotary disc valve and actuation device.
Figure 5B:
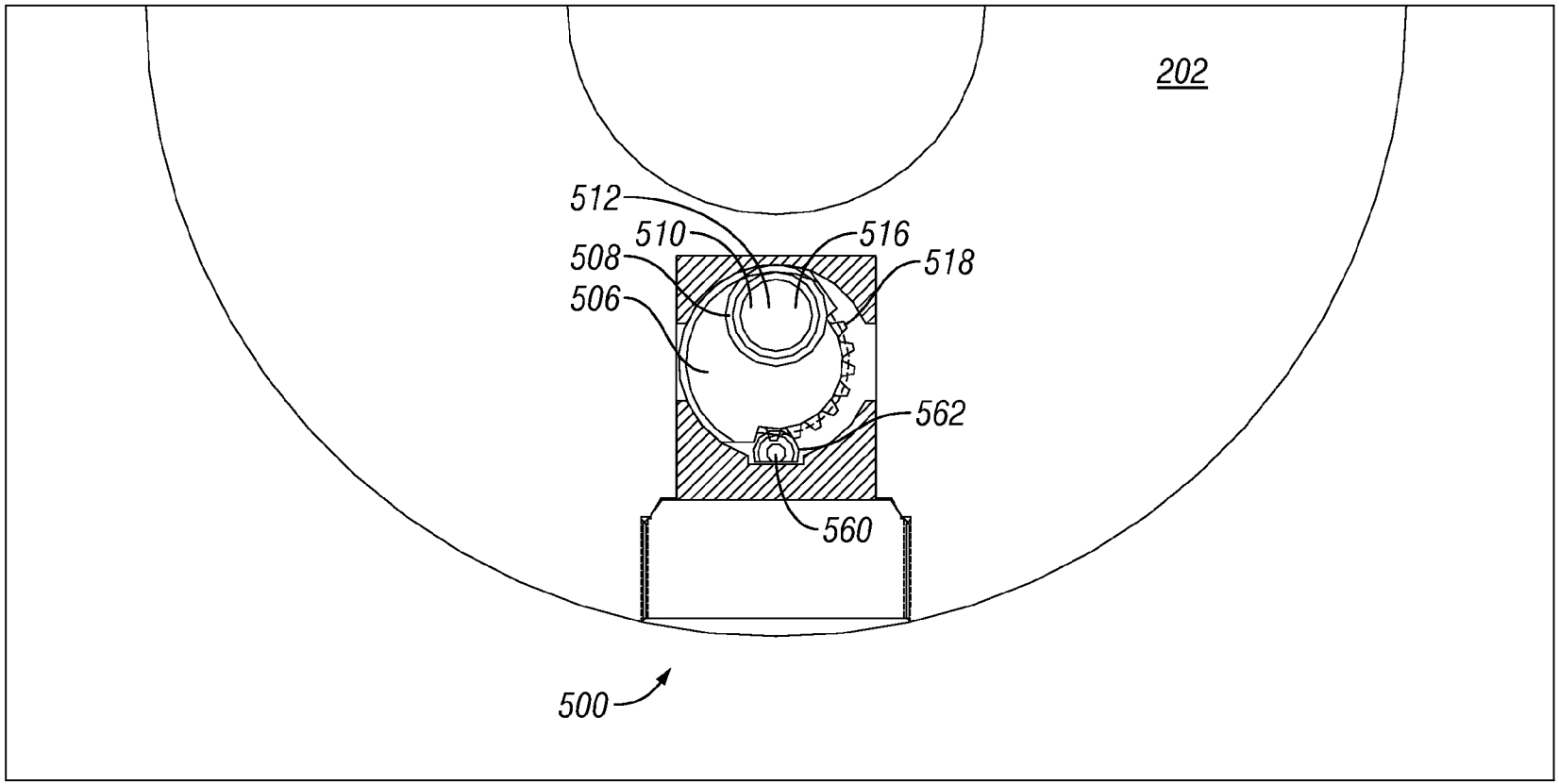
FIG. 5B is a sectional top view of the embodiment of the rotary disc valve and actuation device illustrated in FIG. 5A, wherein the rotary disc valve is in an open position.
Figure 5C:
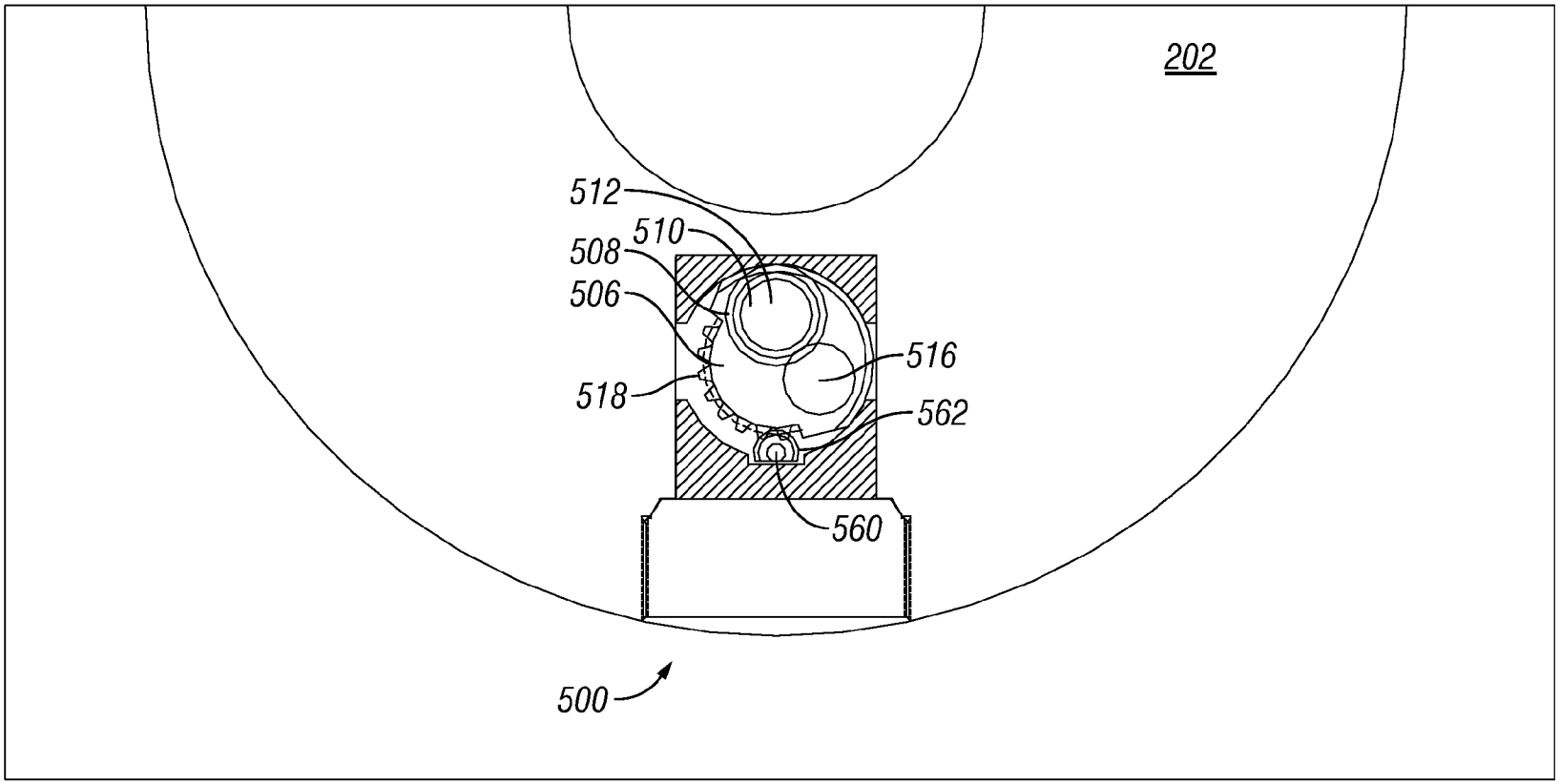
FIG. 5C is a sectional top view of the embodiment of the rotary disc valve and actuation device illustrated in FIG. 5A, wherein the rotary disc valve is in a closed position.

FIGS. 5A-C illustrate another embodiment of a rotary valve assembly 500. The rotary valve assembly 500 includes a valve disc 506 which fits between two valve seats 508. The valve disc 506 includes an aperture 510 through the disc. The valve seats 508 also include apertures 512 through the valve seats. The valve disc 506 is capable of rotation between an open position as illustrated in FIG. 5B and a closed position as illustrated in FIG. 5C. In the open position, the valve disc aperture 510 is aligned with the valve seat apertures 512, thereby allowing fluid to flow through the disc aperture 510 and the valve apertures 512, thereby enabling fluid communication through the annulus bore 516 across the valve. In the closed position, the valve disc aperture 510 is offset from the valve seat apertures 512, thereby restricting fluid communication across the valve. The valve disc 506 can further include gear teeth 518.

In the embodiment illustrated in FIGS. 5A-C, the rotary valve assembly 500 further includes a linear rod 560 disposed axially within the tubing hanger. The linear rod 560 includes gear teeth 562 along the length of the linear rod 560.

The gear teeth 562 of the linear rod 560 engage with the gear teeth 518 of the valve disc 506, causing the valve disc 506 to rotate between the open and closed positions. In the embodiment illustrated in FIGS. 5B-4C, the linear rod 560 is moved axially in order to rotate the valve disc 506.

Figure 6A:
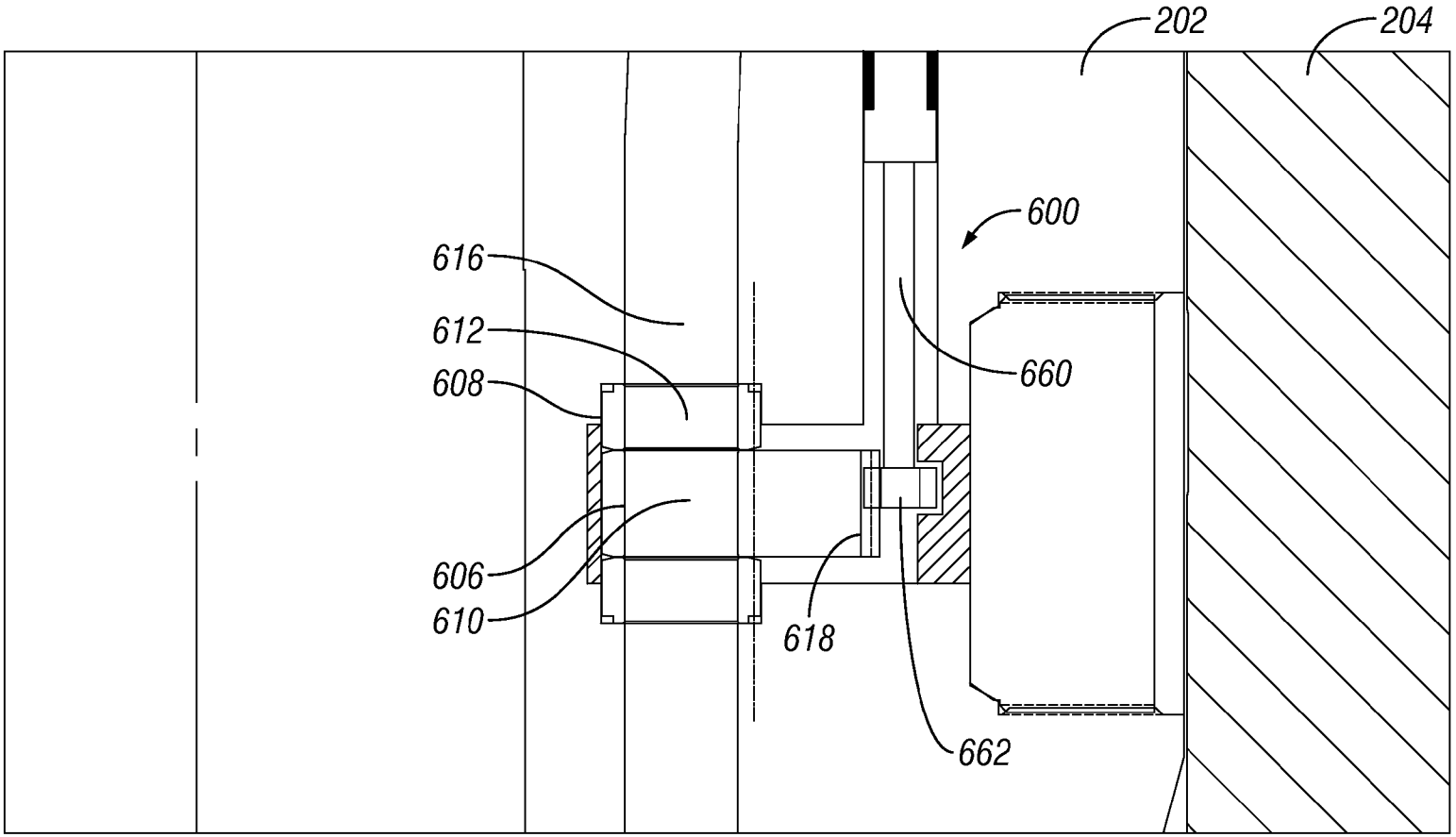
FIG. 6A is a sectional side view of an embodiment of a rotary disc valve and actuation device.
Figure 6B:
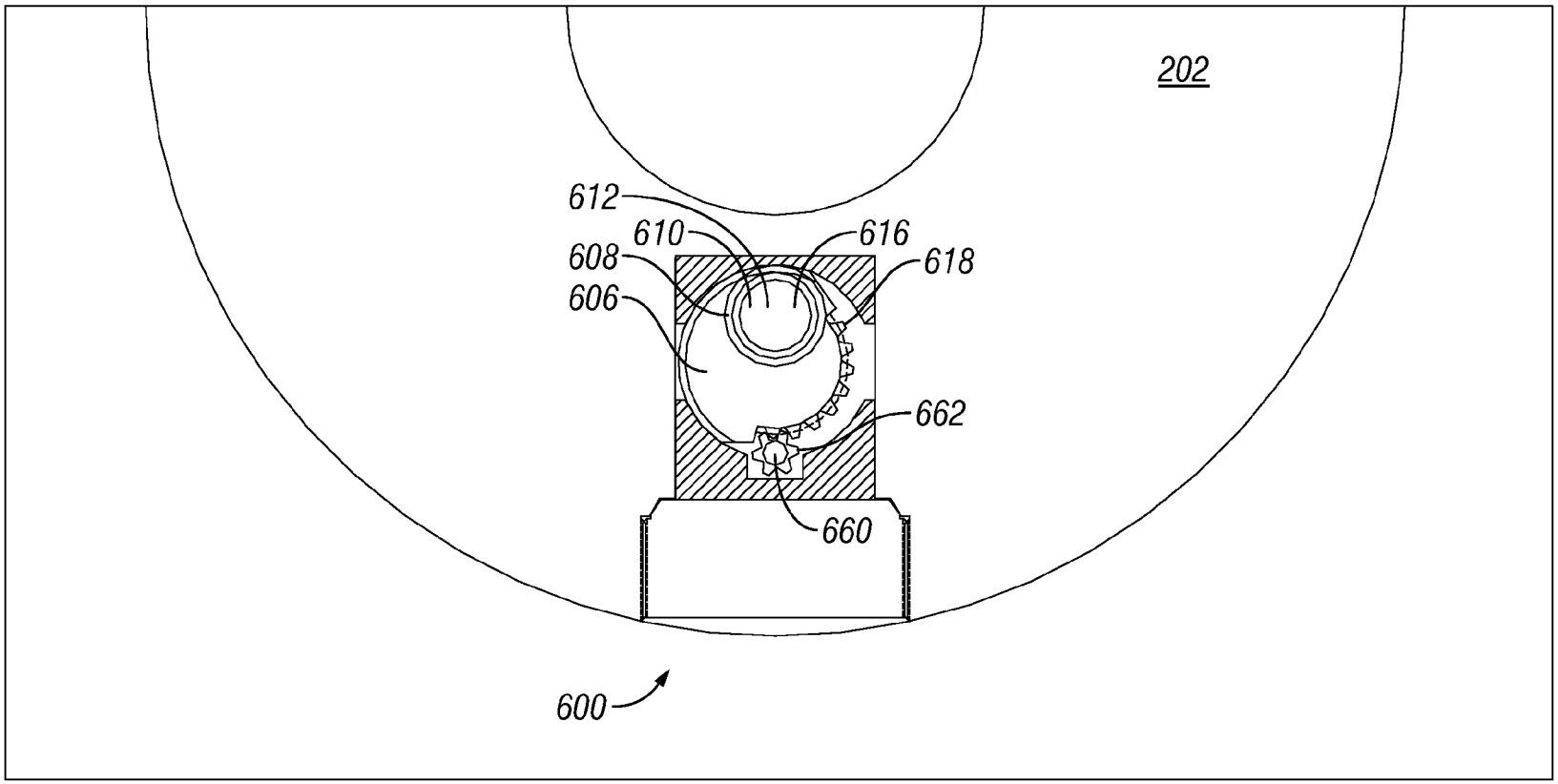
FIG. 6B is a sectional top view of the embodiment of the rotary disc valve and actuation device illustrated in FIG. 6A, wherein the rotary disc valve is in an open position.
Figure 6C:
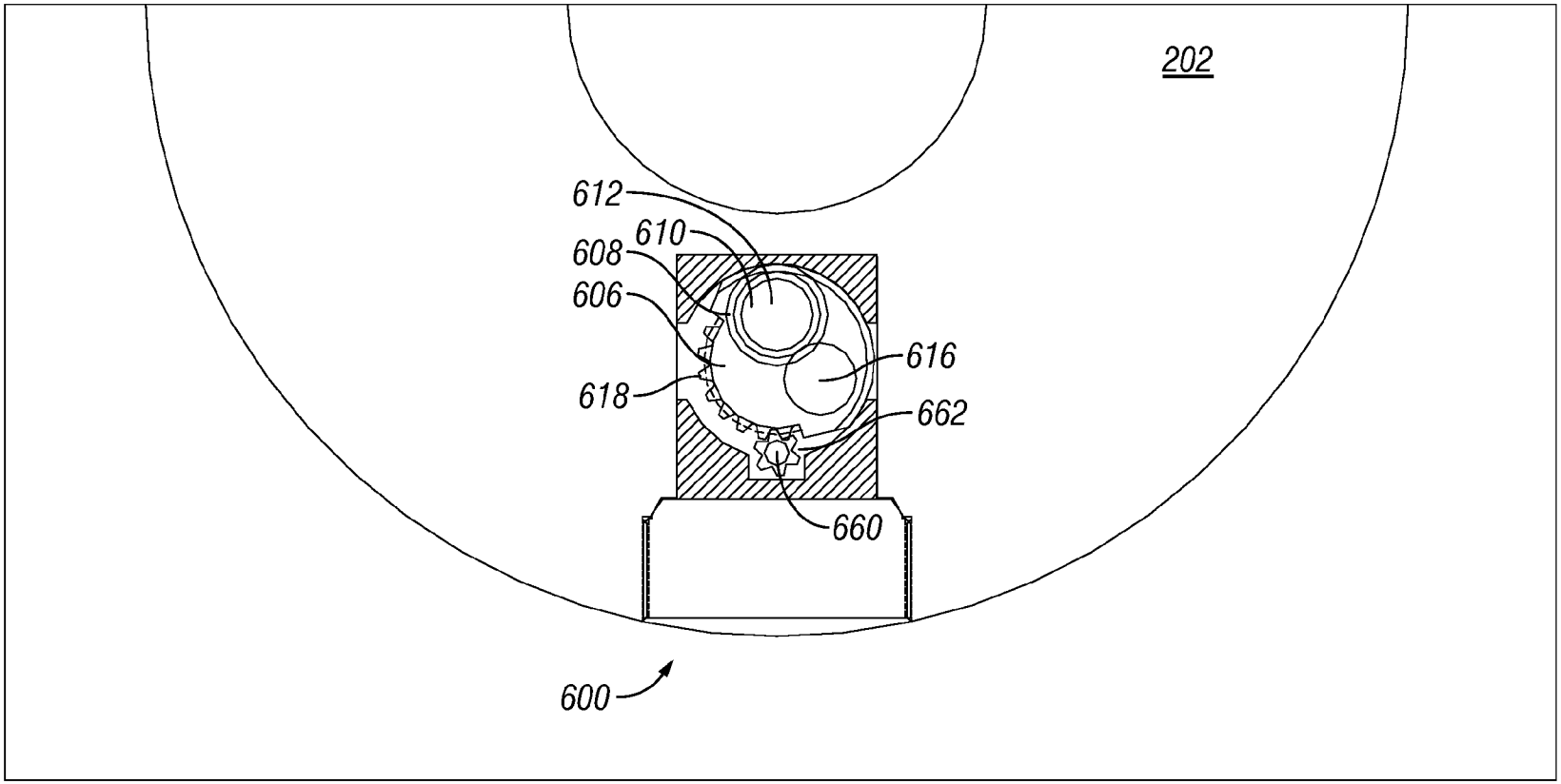
FIG. 6C is a sectional top view of the embodiment of the rotary disc valve and actuation device illustrated in FIG. 6A, wherein the rotary disc valve is in a closed position.

FIGS. 6A-C illustrate another embodiment of a rotary valve assembly 600. The rotary valve assembly 600 includes a valve disc 606 which fits between two valve seats 608. The valve disc 606 includes an aperture 610 through the disc. The valve seats 608 also include apertures 612 through the valve seats. The valve disc 606 is capable of rotation between an open position as illustrated in FIG. 6B and a closed position as illustrated in FIG. 6C. In the open position, the valve disc aperture 610 is aligned with the valve seat apertures 612, thereby allowing fluid to flow through the disc aperture 610 and the valve apertures 612, thereby enabling fluid communication through the annulus bore 616 across the valve. In the closed position, the valve disc aperture 610 is offset from the valve seat apertures 612, thereby restricting fluid communication across the valve. The valve disc 606 can further include gear teeth 618.

In the embodiment illustrated in FIGS. 6A-C, the rotary valve assembly 600 further includes a rotating member 660 axially disposed within the tubing hanger. The rotating member 660 includes a gear 662 at its terminal end. In FIG. 6B, gear teeth 664 are shown cut directly into the rotating member 660. In other embodiments, the gear teeth 664 can be coupled to the rotating member 660 by other means commonly known by those of ordinary skill in the art, such as by adhesive, welding, bolt, screw or other fastener.

The gear 662 engages with the gear teeth 618 of the valve disc 606, causing the valve disc 606 to rotate between the open and closed positions. In the embodiment illustrated in FIGS. 6A-6C, the rotating member 660 can be rotated by any rotating means commonly known to those of ordinary skill in the art, including a hydraulic motor in a tubing hanger, production tree or tubing hanger running tool, an electric motor in a tubing hanger, tree or tubing hanger running tool or a remotely operated vehicle tool on a production tree.

Figure 7:
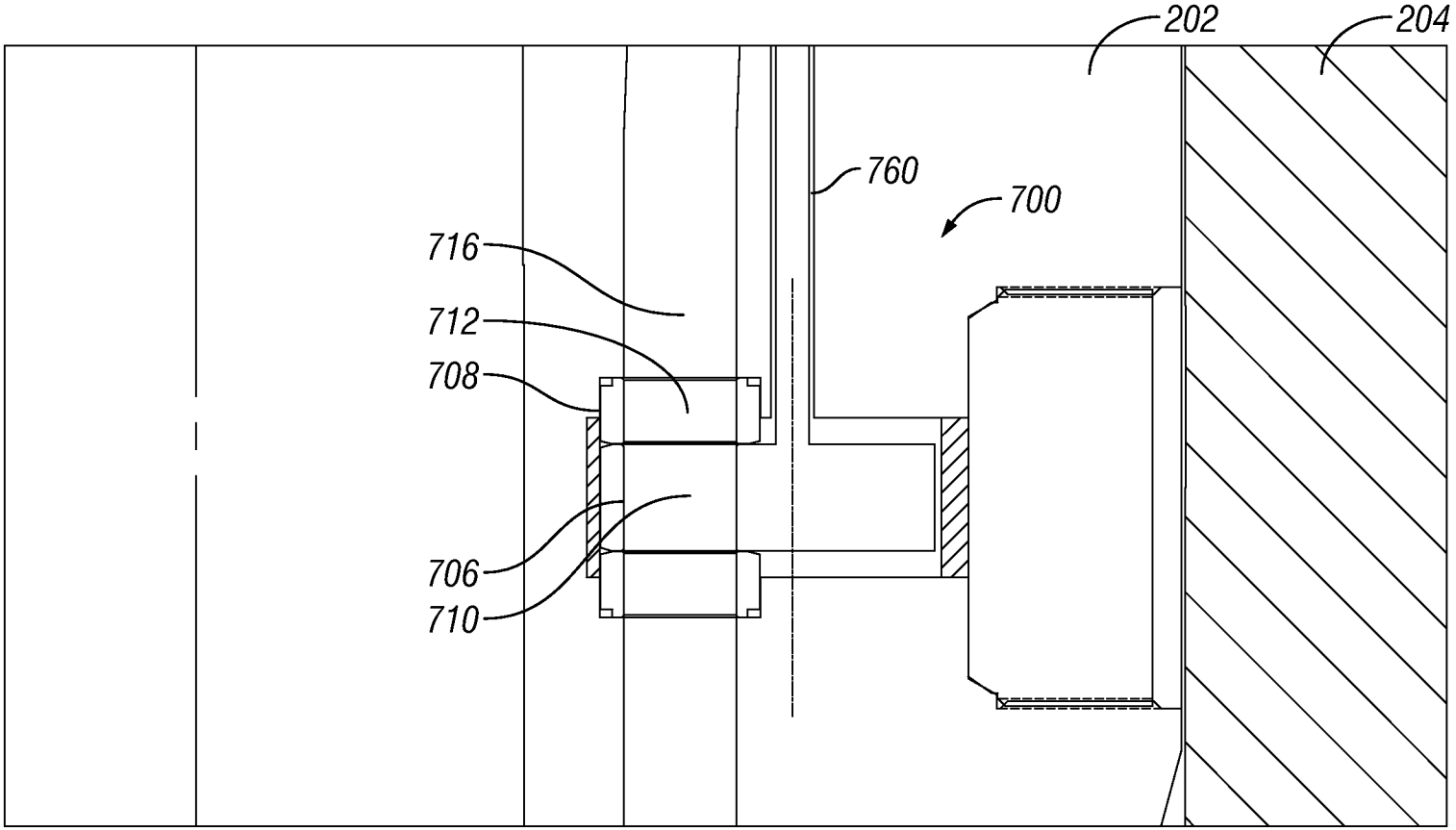
FIG. 7 is a section top view of a rotary disc valve and actuation device.

FIG. 7 illustrates another embodiment of a rotary valve assembly 700. The rotary valve assembly 700 includes a valve disc 706 which fits between two valve seats 708. The valve disc 706 includes an aperture 710 through the disc. The valve seats 708 also include apertures 712 through the valve seats. The valve disc 706 is capable of rotation between an open position as illustrated in FIG. 7 and a closed position as illustrated in FIG. 7. In the open position, the valve disc aperture 710 is aligned with the valve seat apertures 712, thereby allowing fluid to flow through the disc aperture 710 and the valve apertures 712, thereby enabling fluid communication through the annulus bore 716 across the valve. In the closed position, the valve disc aperture 710 is offset from the valve seat apertures 712, thereby restricting fluid communication across the valve. The valve disc 706 can further include gear teeth 718.

In the embodiment illustrated in FIG. 7, the rotary valve assembly 700 further includes a rotating member 760 axially disposed within the tubing hanger. The rotating member 760 is directly coupled to the valve disc 706 and when rotated causes the valve disc 706 to rotate between the open and closed positions. In the embodiment illustrated in FIG. 7, the rotating member 760 can be rotated by any rotating means commonly known to those of ordinary skill in the art, including a hydraulic motor in a tubing hanger, production tree or tubing hanger running tool, an electric motor in a tubing hanger, tree or tubing hanger running tool or a remotely operated vehicle tool on a production tree.

In any of the above-described embodiments, the rotary valve assembly can further includes a front bushing, e.g. 230, and a rear bushing, e.g. 232, located on opposing sides of the rotary valve assembly. The front bushing 230 can be located radially outward from the rear bushing 232. The front bushing 230 and rear bushing 232 provide for precise location of the valve disc 206 as well as control the friction between the valve disc 206 and a locating surface.

In any of the above-described embodiments, the rotary valve assembly may be installed through the side of the tubing hanger. An environmental barrier, e.g. 228, can be used to seal off the tubing hanger. The environmental barrier 228 can be a plug. The tubing hanger could also be sealed by radial seals above and below the rotary valve assembly. A smaller plug 234 can be used to seal off the port used to install the actuating device.

The above-described embodiments can be used to provide an annulus barrier to the environment prior to disconnecting the tree or tubing hanger running tool from the tubing hanger. Although described for use in a tubing hanger, the invention is particularly useful in vertical tree tubing hangers, more particularly a vertical mono-bore tree with the tubing hanger located in the wellhead. However, those of ordinary skill in the art will understand that the rotary disc valve could be used for fluid isolation in wellhead equipment other than a tubing hanger. Those of ordinary skill in the art will further understand that the disclosed rotary disc valve could be used to control fluid flow in an annulus bore, a production bore, or any other type of fluid flow passageway.

The above-described embodiments are fail "as-is." That is, if the valve were damaged or unable to be actuated, the assembly would remain in its current position. However, in another embodiment, it could be adapted to a "fail-closed" or "fail-open" device by adding a spring. Further, two or more of the rotary disc valves could be used in a tubing hanger to provide increased flow control and/or flow area.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A subsea completion system for a subsea well, the system comprising a tubing hanger comprising:

a tubing hanger production bore formed through the tubing hanger;

an annulus bore passage formed through the tubing hanger and separate from the hanger production bore;

an actuatable rotary disc valve comprising a disc rotatable between an open position and a closed position about an axis offset from the tubing hanger production bore to control the flow of fluid through the annulus bore passage.

2. The system of claim 1, wherein the disc further comprises gear teeth.

3. The system of claim 2, wherein:

the actuatable rotary disc valve is actuatable by a rack and pinion assembly comprising an actuation rack, the actuation rack comprising an actuatable piston; and the actuation rack includes gears configured to interface with the disc gear teeth.

4. The system of claim 2, wherein:

the actuatable rotary disc valve is actuatable by a rotating member comprising a gear configured to engage the disc gear teeth; and the assembly is rotatable by at least one of a hydraulic motor, an electric motor, and a remotely operated vehicle.

5. The system of claim 2, wherein:

the actuatable rotary disc valve is actuatable by an axially oriented member comprising pinion gears configured to engage the the disc gear teeth; and axial movement of the axially oriented assembly causes rotation of the rotatable disc.

6. The system of claim 2, wherein:

the actuatable rotary disc valve is actuatable by an axially oriented rotating member comprising a gear to engage the the disc gear teeth; and rotation of the axially oriented assembly causes rotation of the disc.

7. The system of claim 1, wherein:

the actuatable rotary disc valve is by a slot pin assembly comprising a hydraulically actuated piston comprising actuatable a slot;

the disc comprises a pin; and the slot interfaces with the pin.

8. The system of claim 1, wherein:

the actuatable rotary disc valve is actuatable by an axially oriented rotating member coupled directly to the disc; and rotation of the axially oriented assembly causes rotation of the disc.

9. The system of claim 1, further comprising bushings on opposing sides of the actuatable rotary valve.

10. The system of claim 1, wherein the actuatable rotary valve is fail as is.

11. The system of claim 1, wherein the actuatable rotary valve is fail closed.

12. The system of claim 1, wherein the actuatable rotary valve is fail open.

13. The system of claim 1, further comprising another actuatable rotary valve.

14. A completion system for a subsea well, the system comprising:

a wellhead housing comprising a central bore;

a production tree;

a tubing hanger supportable in the central bore of the wellhead housing, the tubing hanger comprising:

a hanger production bore formed through the tubing hanger;

an annulus bore passage formed through the tubing hanger separate from the hanger production bore;

an actuatable rotary disc valve comprising a disc rotatable between an open position and a closed position about an axis offset from the hanger production bore to control the flow of fluid through the annulus bore passage or hanger production bore; and wherein the tubing hanger annulus bore passage is in fluid communication with an annulus below the tubing hanger.

15. The system of claim 14, wherein the disc further comprises gear teeth.

16. The system of claim 15, wherein:

the actuatable rotary disc valve is actuatable by a rack and pinion assembly comprising an actuation rack, the actuation rack comprising an actuatable piston; and the actuation rack comprising gears configured to interface with the disc gear teeth.

17. The system of claim 15, wherein:

the actuatable rotary disc valve is actuatable by a rotating member comprising a gear configured to engage the disc gear teeth; and the assembly is rotatable by at least one of a hydraulic motor, an electric motor, and a remotely operated vehicle.

18. The system of claim 15, wherein:

the actuatable rotary disc valve is actuatable by an axially oriented member comprising pinion gears configured to engage the disc gear teeth; and axial movement of the axially oriented assembly causes rotation of the disc.

19. The system of claim 15, wherein:

the actuatable rotary disc valve is actuatable by an axially oriented rotating member comprising a gear configured to engage the the disc gear teeth; and rotation of the axially oriented assembly causes rotation of the disc.

20. The system of claim 14, wherein:

the actuatable rotary disc valve is actuatable by a slot pin assembly comprising a hydraulically actuated piston comprising a slot;

the disc comprises a pin; and the slot interfaces with the pin.

21. The system of claim 14, wherein:

the actuatable rotary disc valve is actuatable by an axially oriented rotating member coupled directly to the disc; and rotation of the axially oriented assembly causes rotation of the disc.

22. The system of claim 14, further comprising bushings on opposing sides of the actuatable rotary valve.

23. The system of claim 14, wherein the actuatable rotary disc valve is fail as is.

24. The system of claim 14, wherein the actuatable rotary disc valve is fail closed.

25. The system of claim 14, wherein the actuatable rotary disc valve is fail open.

26. The system of claim 14, further comprising another actuatable rotary disc valve.

* * * * *